US009504344B2

(12) United States Patent
Sarvestani

(10) Patent No.: US 9,504,344 B2
(45) Date of Patent: Nov. 29, 2016

(54) AUTOMATED ARTICLE DELIVERY AND COLLECTING MACHINE

(71) Applicant: Seyed Amin Ghorashi Sarvestani, Keppel Bay (SG)

(72) Inventor: Seyed Amin Ghorashi Sarvestani, Keppel Bay (SG)

( * ) Notice: Subject to any disclaimer, the term of this patent is extended or adjusted under 35 U.S.C. 154(b) by 63 days.

(21) Appl. No.: 14/482,721

(22) Filed: Sep. 10, 2014

(65) Prior Publication Data

US 2016/0066732 A1 Mar. 10, 2016

(51) Int. Cl.

| | |
|---|---|
| ***A47G 29/12*** | (2006.01) |
| ***A47G 29/14*** | (2006.01) |
| ***G07F 17/26*** | (2006.01) |

(52) U.S. Cl.

CPC ..... *A47G 29/1201* (2013.01); *A47G 29/141* (2013.01); *G07F 17/26* (2013.01); *A47G 2029/143* (2013.01)

(58) Field of Classification Search

CPC ..... A47G 29/1201; A47G 29/1218; A47G 29/122; A47G 29/141; A47G 29/143; A47G 29/146; A47G 2029/148; A47G 2029/149; A47G 29/16; A47G 29/30; A47B 96/025; A47B 45/00; A47B 51/00; B65G 1/127; G07F 19/00; G07F 17/26; B65D 25/04; B65F 1/0046

USPC ..... 232/24, 25, 19; 235/379; 312/313; 340/5.73, 569; 220/531, 524

See application file for complete search history.

(56) References Cited

U.S. PATENT DOCUMENTS

| | | | | |
|---|---|---|---|---|
| 624,115 | A | 5/1899 | Steele | |
| 1,625,294 | A | 4/1927 | Whitesides | |
| 1,817,191 | A * | 8/1931 | Harmony | A47G 29/1201 232/17 |
| 3,485,544 | A | 12/1969 | Beckerman | |
| 4,582,003 | A | 4/1986 | Valero | |
| 4,736,689 | A | 4/1988 | Stanko | |
| 4,854,246 | A | 8/1989 | Belokin et al. | |
| 5,203,619 | A | 4/1993 | Welsch | |
| 5,774,053 | A * | 6/1998 | Porter | A47G 29/141 232/19 |
| 5,820,237 | A | 10/1998 | Robey | |
| 6,450,598 | B1 | 9/2002 | Hanel | |
| 6,612,669 | B2 | 9/2003 | Grueneberg | |
| 6,715,623 | B2 | 4/2004 | Broerman | |
| 6,848,371 | B2 | 2/2005 | Zheng | |
| 6,994,409 | B2 | 2/2006 | Godlewski | |

(Continued)

FOREIGN PATENT DOCUMENTS

| | | |
|---|---|---|
| EP | 0508903 | 7/1995 |
| EP | 2256068 | 7/2011 |
| WO | WO2013176621 | 11/2013 |

*Primary Examiner* — William Miller

(74) *Attorney, Agent, or Firm* — Emerson Thomson Bennett, LLC

(57) ABSTRACT

Provided is a storage unit for depositing articles for subsequent retrieval. The storage unit includes a plurality of storage compartments with at least one retractable and foldable shelf member within each storage compartment. The storage unit also includes a set of doors configured to cooperate with each other and movable between a closed configuration which disallows access to the plurality of storage compartments and an opened configuration which allows access to the plurality of storage compartments. A control system which includes a computer, a processor board and software is also included with the storage unit. The control system may receive and process an input allowing the set of doors to be moved to an open configuration and may selectively define an access opening between the set of doors for accessing a storage section selected from at least one of the storage compartments.

17 Claims, 10 Drawing Sheets

(56) References Cited

U.S. PATENT DOCUMENTS

| | | | | |
|---|---|---|---|---|
| 7,068,149 | B2 * | 6/2006 | Lee | G06Q 10/08 232/24 |
| 7,337,944 | B2 * | 3/2008 | Devar | A47G 29/141 232/19 |
| 8,414,093 | B2 | 4/2013 | Moran | |
| 8,443,991 | B1 | 5/2013 | Ivey, III | |
| 8,714,669 | B1 | 5/2014 | Clausen | |
| 2001/0045449 | A1 * | 11/2001 | Shannon | A47G 29/141 232/19 |
| 2005/0258117 | A1 | 11/2005 | Drake | |
| 2006/0151588 | A1 * | 7/2006 | Mikolajczyk | A47G 29/1201 232/24 |
| 2011/0042910 | A1 | 2/2011 | Ceballos-Godefroy | |
| 2013/0241384 | A1 | 9/2013 | Strauss et al. | |
| 2013/0264381 | A1 * | 10/2013 | Kim | A47G 29/122 232/24 |

* cited by examiner

AUTOMATED ARTICLE DELIVERY AND COLLECTING MACHINE

I. BACKGROUND

A. Technical Field

Provided is an apparatus for depositing and retrieving the articles. More specifically, but not exclusively, provided is an apparatus for depositing and picking up parcels, goods, mails and postal packages.

B. Description of Related Art

Conventional mailboxes have multiple compartments, each as a separate mailbox with fixed dimensions, which are assigned to an owner who has access to their box using a key or an electronic code. Such a conventional approach to mailboxes has many limitations. For example, each box must have a physical identification to allow the delivery person to identify the owner, each owner must own one mailbox compartment, there is no possibility of sharing the same mailbox compartment with other owners when it is not in use and the size of articles for delivery and retrieval from the mailbox compartment are limited to the size of the compartment.

It is an object of the present disclosure to provide an apparatus for depositing articles for subsequent retrieval which alleviates the above mentioned disadvantages of conventional mailboxes and which also provides a more efficient way to utilize municipal resources.

II. SUMMARY

Provided is a storage unit for depositing articles for subsequent retrieval. The storage unit may include the following components: a plurality of storage compartments; at least one retractable and foldable shelf member within each storage compartment, each retractable and foldable shelf member having a front side and a back side; a set of doors configured to cooperate with each other and movable between a closed configuration which disallows access to the plurality of storage compartments and an opened configuration which allows access to the plurality of storage compartments; and a control system comprising a computer, a processor board and software for receiving and processing an input and for moving the set of doors to the open configuration based on the input and to selectively define an access opening between the set of doors for accessing a storage section, the storage section being selected from at least one of the storage compartments.

According to further embodiments, the storage unit may include an input which includes a dimension of an article to be deposited, and the control system may be configured to assign at least one of the storage compartments as the storage section based on the dimension and the input may further include a unique code which is associated with the storage section.

According to further embodiments, the storage unit may include two or more storage compartments assigned as the storage section and the access opening may be arranged to match the openings of the two or more storage compartments.

According to further embodiments, the storage unit control system may calculate freight charge and payment may be accepted by a debit/credit card through a smart card reader and writer, Near Field Communication (NFC) through a NFC/RFID card reader or cash through a cash recycle unit to dispense and deposit bank notes.

According to further embodiments, the storage unit may include at least one retractable and foldable shelf member within each storage compartment which defines the size of the storage compartment, the retractable and foldable shelf members being movable between an in-use position in which the shelf members are arranged for supporting the articles to be deposited and a stored position which merges at least two of the storage compartments to create a larger storage compartment.

According to further embodiments, each shelf member within the storage unit may include two foldable parts which are foldable along multiple lap joints.

According to further embodiments, each shelf member may be foldable at the middle of the shelf along the multiple lap joints, furthermore, the foldable parts may fold from the middle and turn approximately 90 degrees to position the two foldable parts along the interior wall of the storage unit.

According to further embodiments, the two foldable parts of each shelf member within the storage unit may fold from the middle and turn approximately 90 degrees to position the two foldable parts at a first side wall, a second side wall, a back wall or a front wall along the interior wall of the storage unit.

According to further embodiments, each storage compartment of the storage unit includes at least two retractable and foldable shelf members.

According to further embodiments, the storage unit may include a first retractable and foldable shelf member which folds from the middle and turns approximately 90 degrees to position the two foldable parts at a first side wall along the interior wall of the storage unit and a second retractable and foldable shelf member which folds from the middle and turns approximately 90 degrees to position the two foldable parts at a second side wall along the interior wall of the storage unit.

According to further embodiments, the storage unit may include a first retractable and foldable shelf member which folds from the middle and turns approximately 90 degrees to position the two foldable parts at a back wall along the interior wall of the storage unit and a second retractable and foldable shelf member folds from the middle and turns approximately 90 degrees to position the two foldable parts at a front wall along the interior wall of the storage unit. In such embodiments, access to the storage compartment may be provided by a side wall on the storage unit.

According to further embodiments, the storage unit may include retractable and foldable shelf members which include a guiding pin on the front side and a guiding pin on the back side of the shelf member, each guiding pin being capable of moving inside a corresponding front side and back side guide rail to hold foldable parts in the correct position during the retracting process, to provide more strength to the shelves to hold a load at the flat position, and to provide a seal between the doors of the storage unit.

According to further embodiments, the storage unit may include a bidirectional electric motor which provides movement to retract the foldable shelf members, wherein the bidirectional electric motor turns a shaft transferring movement to a first gear, wherein movement of the first gear transfers movement to a main movement gear, wherein movement of the main movement gear transfers movement to a first moving arm by a first belt and a second movement arm by a coupling gear and a second belt, wherein the moving arms are connected to the foldable parts by connecting arms and the connecting arms are attached to the foldable parts by a square shaft.

According to further embodiments, the control system of the storage unit may include a touch screen display for entering an input, a graphical user interface which allows users to enter details of a sender and a receiver of an article, a printer to print shipment documents and payment receipts, a finger print scanner to identify operators, a barcode scanner to enter shipping and receiving information from article barcodes, a security camera to record activities during operation, a secure Personal Identification Number (PIN) pad, and a display screen for advertisements.

According to further embodiments, the storage unit may include a lock mechanism arranged to lock the set of doors in the closed configuration and unlock the set of doors in the open configuration, wherein the lock mechanism comprises an electronic lock which is controlled by the storage unit processor board.

According to further embodiments, the set of doors of the storage unit may include a door having a top side and a bottom side corresponding to each storage compartment and a guide rail having a top side and a bottom side between each door, wherein the top side of each door includes a joining pin which can engage a hole in the bottom side of the guide rail and the bottom side of each door includes a joining pin which can engage a hole in the top side of the guide rail.

According to further embodiments, the joining pins within the set of doors of the storage unit may be activated by an electric actuator embedded in each door and controlled by the storage unit processor board.

According to further embodiments, the back side guide rail of the storage unit may be in a fixed position and the front side guide rail may be movable, wherein the set of doors and the front side guide rail have one of a right hand swing, a left hand swing, a top swing and a bottom swing.

Also provided is a method of operating a storage unit for depositing articles for subsequent retrieval. The method includes the following steps: entering an input into the control system which includes an article's dimensions; allowing the control system to retract or extend the foldable shelf member from at least one of the storage compartments based on the dimension of the article entered with the input; allowing the control system to selectively define the access opening by determining a number of doors to be mechanically connected and opened together; allowing the control system to send an instruction to mechanically connect the appropriate number of doors based on the determined size of the storage compartment; moving the set of doors to the open configuration based on the entered input to create an access opening to a storage section; placing the article within the storage compartment; and closing the set of doors.

III. BRIEF DESCRIPTION OF THE DRAWINGS

The disclosed apparatus of automated delivery and collecting machine and corresponding methods may take physical form in certain parts and arrangement of parts, embodiments of which will be described in detail in this specification and illustrated in the accompanying drawings which form a part hereof and wherein.

IV. DETAILED DESCRIPTION

Figure 1:
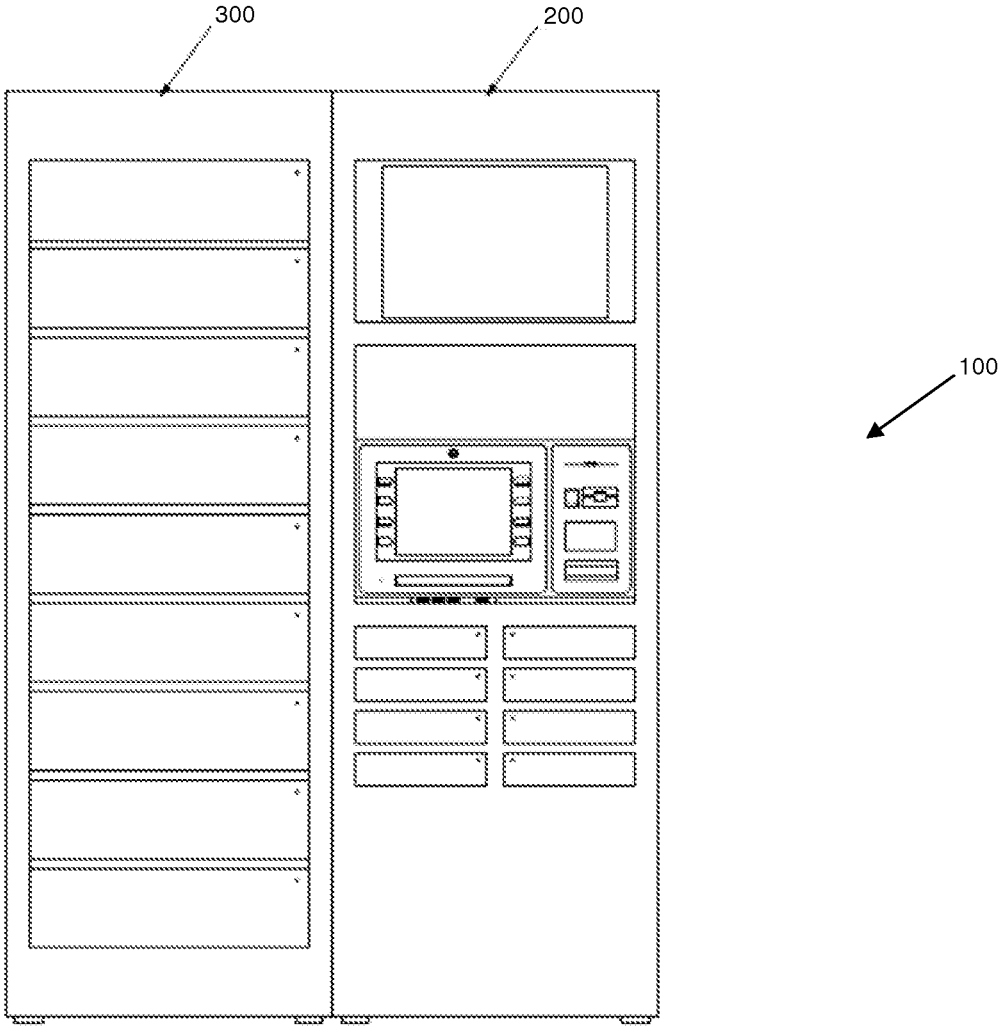
FIG. 1 is a front view of the automated article delivery and collecting machine having a set of doors which are closed.

Provided is an apparatus for depositing articles for subsequent retrieval. The apparatus includes a cabinet-like body defining a storage space for storing articles including but not limited to mails or parcels. The cabinet-like body is formed by two side walls which define a height and a depth of the apparatus, a back wall which defines the width (and height) of the apparatus, top and bottom walls and a front side which allows access to a storage space within the cabinet body. The apparatus includes a set of movable doors for closing the front of the cabinet body.

In certain embodiments, the apparatus may include a storage unit with a plurality of storage compartments; a set of doors configured to function individually and/or cooperate with each other and joining together to build a larger door. The doors may function individually or collectively based on the needs of the user and/or the size of the article or package to be deposited within the storage compartment. In certain scenarios, the doors may be in a closed configuration to prevent or disallow access to a corresponding storage compartment when not needed while in other scenarios the doors may be in an open configuration to allowed access to a corresponding storage compartment(s) when such storage compartment(s) are required for depositing an article or package. In certain embodiments, the apparatus may include an electric lock mechanism to lock the doors in the closed configuration and unlock them in open configuration.

In other embodiments, the doors may be in a joined configuration. In such joined configuration, the doors may be attached to each other to form a larger door. When this larger door is in the open configuration, access is allowed to a plurality of storage compartments matched to the corresponding doors. Alternatively, when this larger door is in a closed configuration access to the plurality of storage compartments which correspond to those doors is disallowed or prevented. Whether the doors operate in an individual or joined configuration may be determined by a control unit. Such a control unit may receive an input for accessing the storage compartment and for configuring the doors based on the input entered for the open configuration. The control unit then selectively defines the set of doors for accessing a plurality of compartments. In certain embodiments, the storage section may be selected from at least two storage compartments.

An advantage of the above-described embodiment is that by having a set of attachable doors which selects a suitable storage section for an article based on the input, greater flexibility is provided with regard to accessing a storage space having the required size to store an article. In addition, greater convenience is provided to operators and users since there is no need for the user to know precisely where the articles are to be deposited or retrieved since this is determined by the control unit. Furthermore, each of the storage compartments comprise foldable shelves which allow the storage compartments to be reconfigurable for resizable to a suitable size for receiving articles allowing for greater flexibility and options to the user. In this way, the apparatus maximizes the usage of space for any standard size article by offering appropriate compartment location and selectable size storage compartments based on space availability.

The disclosed apparatus may be suitable as an apparatus for the postal service, courier companies, or automation industry to deliver mail or articles at an unattended self-service point at the first and/or last mile of the logistic chain. The apparatus may also be suitable as a general storage facility or storage unit for depositing or storing goods for a period of time for retrieval later. The apparatus may be placed in public areas such as locker rooms, transportation hubs, hotels, recreation facilities, libraries, article rental/vending areas, residential complexes, business parks, retail centers or may be used by businesses or private parties for secured handover or transfer of goods and/or articles, etc. This result is a flexible and self-service solution for an unattached apparatus for depositing and picking up of parcels, goods, mail etc. Exemplary non-limiting embodiments of the apparatus include a mailbox, a storage unit or any other apparatus for placing and retrieving articles.

In certain embodiments, the input to the control unit includes the dimensions of an article to be deposited. In such embodiments, the control unit is configured to assign at least one of the storage compartments as the storage section based on the dimensions. In the event that two (or more) of the storage compartments are assigned as the storage section, the access opening is arranged to attach the doors corresponding to those two (or more) storage compartments.

The input sent to the control unit may include a unique code which is associated with the storage section. In certain embodiments, this input code will allow the user to obtain access to the storage compartment.

In further embodiments, the apparatus may include a plurality of shelf members defining a plurality of storage compartments. In certain embodiments, the shelf members may be movable between a flat position in which the shelf members are arranged for supporting the articles to be deposited and a folded position which merge at least two of the storage compartments to create a larger storage compartment. In certain embodiments, the shelf members are foldable. This enables the shelf members to retract to a side along the interior of the apparatus or storage unit to create a larger storage area for larger articles.

In certain embodiments, the control unit may include sensors for detecting the position and presence of the shelf members (i.e., shelf sensors). In further embodiments, the storage unit may include sensors for detecting the status of the set of doors including whether the doors are in the closed or open configuration and how many doors are mechanically connected to each other in the open configuration. In yet further embodiments, the control unit may further include optical sensors for detecting obstructions to the movement of the set of movable doors in the open configuration.

As it can be appreciated, the recipient may pick up the item at his/her convenience and not be restricted to opening or closing times of traditional mail counters, such as post offices. When the recipient arrives at the apparatus, the recipient uses the user interface to input the unique code. On receipt of the unique code from the user interface, the processor checks the memory for the associated storage section which is the first storage compartment and the processor then opens the corresponding set of doors in a similar manner as previously explained, to create access to the corresponding storage compartment holding the deposited item(s) while disallowing access to the other storage compartments. The recipient retrieves the item and closes the set of doors corresponding to the open storage compartment. In certain embodiments, if the recipient overlooks to close the doors, the processor may automatically send an instruction to close the doors after a certain pre-determined period of time has passed.

In the event that the article to be stored is greater than the size of the storage compartments, for example, requiring twice the size of the default storage compartments, the processor may control the re-positioning of certain shelves within the storage compartment to create a larger storage compartment. The re-positioning of the shelves may be detected by the shelf sensors which informs the processor so that the processor may record the reconfiguration. The processor may also control a joining mechanism within the set of doors to attach two or more doors together to create an access opening which corresponding to the newly formed storage compartment. Subsequent steps are similar to what has been explained earlier i.e. the central system generates a unique code which is associated with the reconfigured storage area by the processor and sends the unique code to the recipient. To retrieve the item, the recipient inputs the unique code for the apparatus to open to allow the recipient to gain access to the appropriate storage section without having access to the remainder of the storage compartments.

Figure 2:
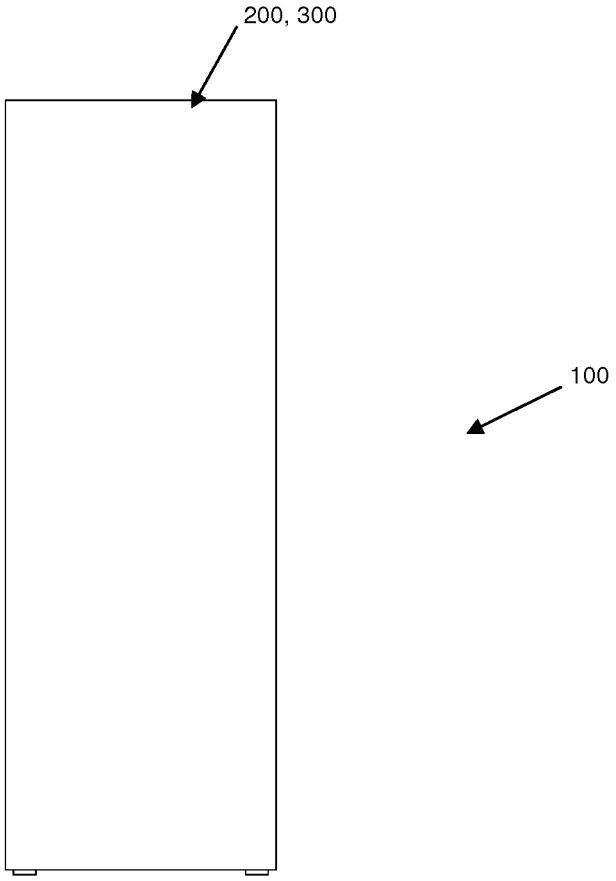
FIG. 2 is a side view of the automated article delivery and collecting machine.
Figure 3:
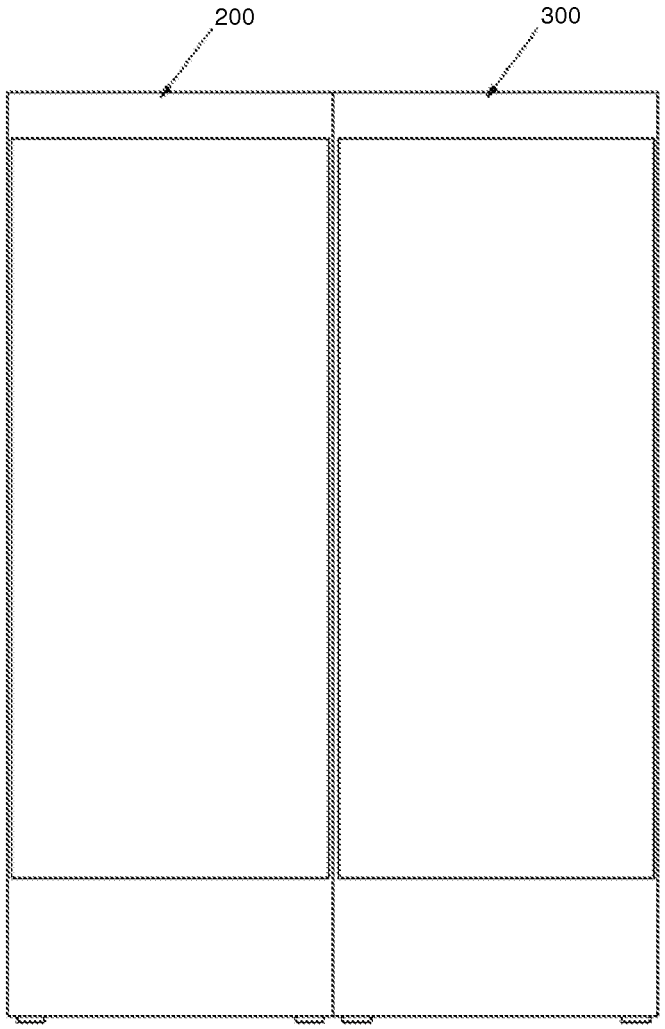
FIG. 3 is a back view of the automated article delivery and collecting machine.

Referring now to the drawings wherein the showings are for purposes of illustrating embodiments of the apparatus only and not for purposes of limiting the same, and wherein like reference numerals are understood to refer to like components. FIGS. 1-3 show an exemplary apparatus for depositing and retrieving articles (100). The apparatus (100) may, in certain embodiments, include two cabinet-like bodies, the control unit (200) and the storage unit (300). The control unit (200) may be capable of providing access to the storage unit (300) and enable users or operators to access the required storage space for depositing or retrieving the articles. The storage unit (300) provides the storage space for depositing and retrieving articles.

Figure 4:
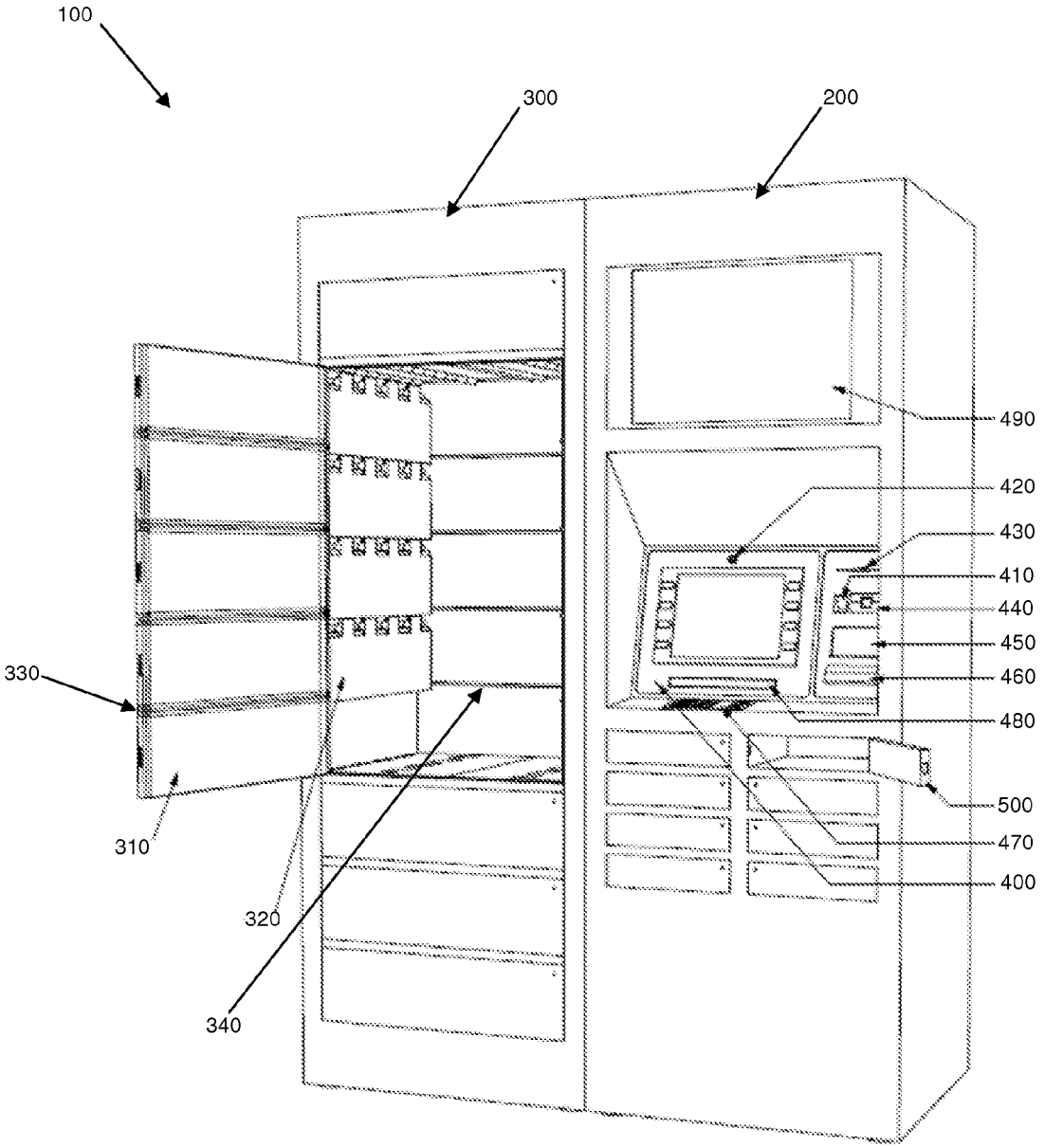
FIG. 4 is a perspective front view of the automated article delivery and collecting machine illustrating several doors attached to each other in an opened position and several shelves retracted to provide the storage space.
Figure 5:
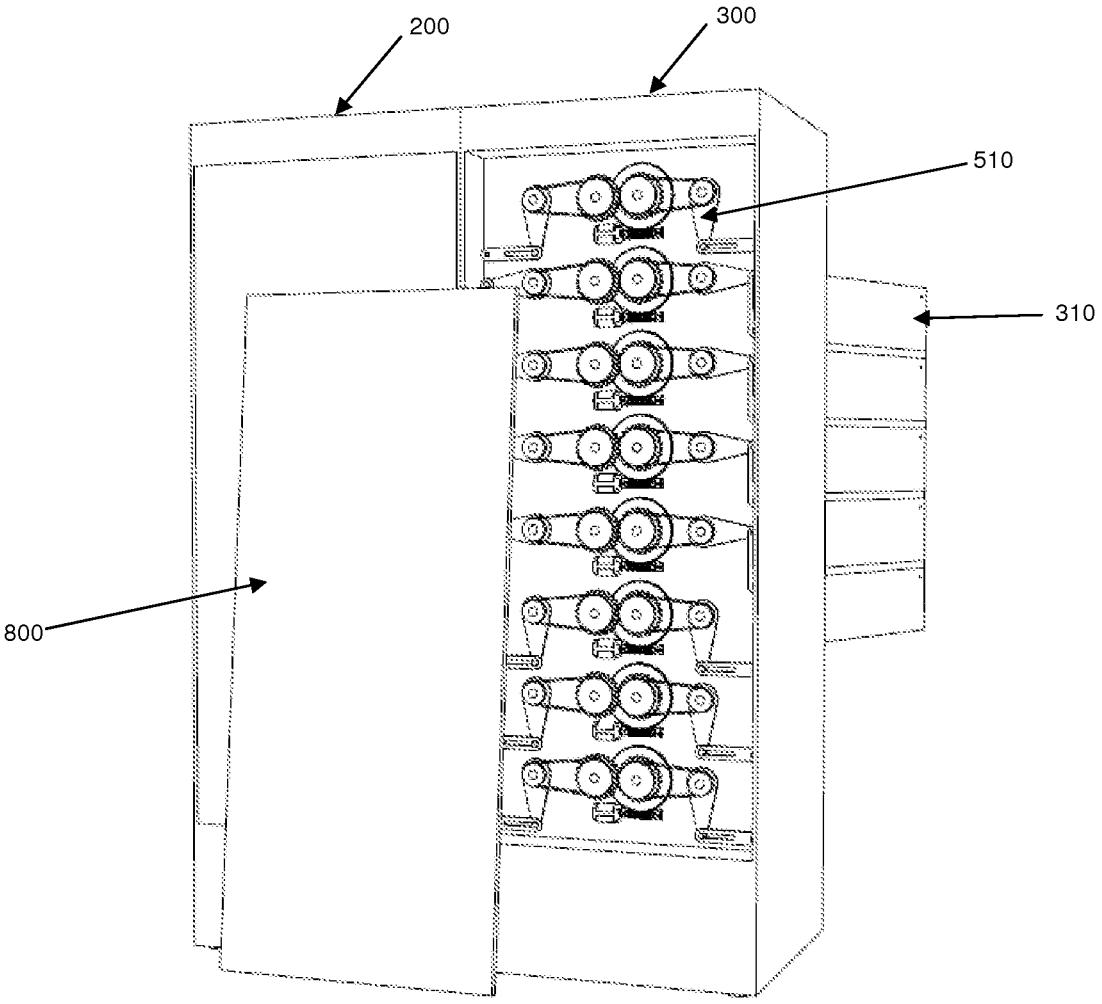
FIG. 5 is a perspective back view of the automated article delivery and collecting machine.
Figure 6:
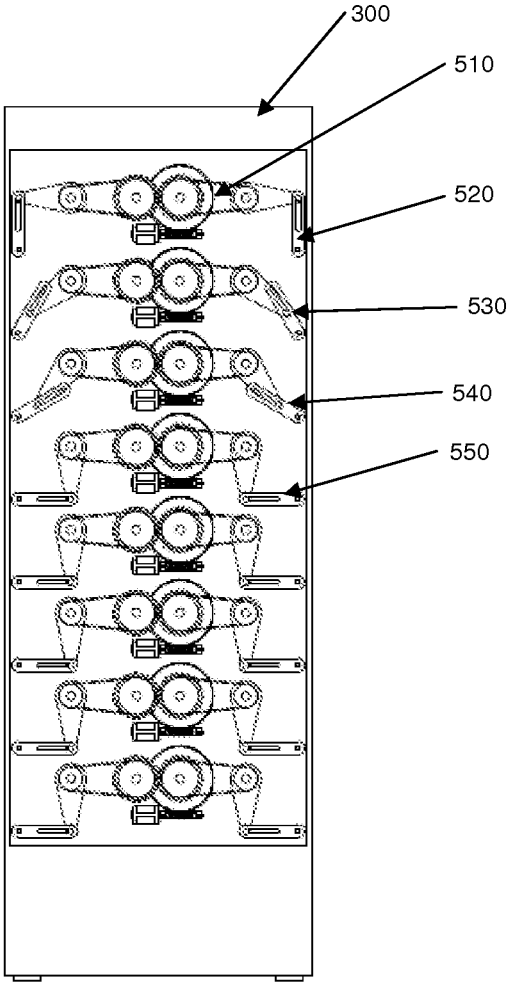
FIG. 6 is a back view of the storage compartment of the automated article delivery and collecting machine demonstrating the shelf mechanism in different retracting stages.

A) Control Unit:

Referring to FIG. 4, each control unit (200) can control and manage an unlimited number of storage units (300). The control unit (200) can accomplish this function by monitoring and managing the available spaces in the storage units (300). The control unit (200) may include a computer and software which enables users and operators to access storage units (300) by interfacing with a keyboard or a touch screen display (400). Through the touch screen display (400), users and operators can select the appropriate storage compartment in any available storage unit (200) connected to the control unit (200) in accordance with the size of the article to be stored. In certain embodiments, a graphical user interface allows users to enter the details of the sender and the receiver. In further embodiments, the control unit (200) may calculate the freight charge and provide a means by which payment may be accepted. For example, the control unit (200) may provide a means for making payment by debit/credit card, Near Field Communication (NFC) or cash.

In certain embodiments, the control unit (200) may also provide a means wherein shipment documents and receipts can be printed.

To provide the security the control unit (200) may include a finger print scanner (410) to register the identity of the users or the operators. A camera (420) may also be included as a security feature in certain embodiments to record all activities which take place around the apparatus (100) during the day.

As mentioned above, the control unit (200) may include a printer (430) to print the shipment documents and payment receipts and security features such as a finger print scanner (420) to identify the users of operators of the apparatus (100) and a camera (420) to record the activities that take place around the apparatus (100) during operation. In addition, the control unit (200) may, in certain embodiments, include a motorized smart card reader and writer (440), a NFC/RFID card reader (450), a barcode scanner (460), a secure Personal Identification Number (PIN) pad (470) to enter the PIN, a cash recycle unit (480) to dispense and deposit the bank notes, a display screen (490) for advertisement and a limited number of fixed storage compartments (500) to utilize the available space in control unit.

B) Storage Unit:

With continued reference to FIG. 4, in certain embodiments, the storage unit (300) may a cabinet-like body defining a storage space for storing articles such as mail, parcels or various sized articles. The storage unit (300) may include the following components: attachable or joined doors (310), retractable shelves (320), and guide rails (330) and (340). Operation of the storage unit (300) may be controlled by the Processing Unit (not shown here).

B-1) Attachable Doors:

Each storage unit has number of doors (310) which can function individually as a small door to allow access to a corresponding matching shelf, or which can be attached together to form a larger door which can allow to access to a larger sized storage space. In order for attached doors to provide access to a larger storage space shelves within at least one storage space are removed. In certain embodiments, these shelves are folded to provide for a larger storage space.

Figure 9:
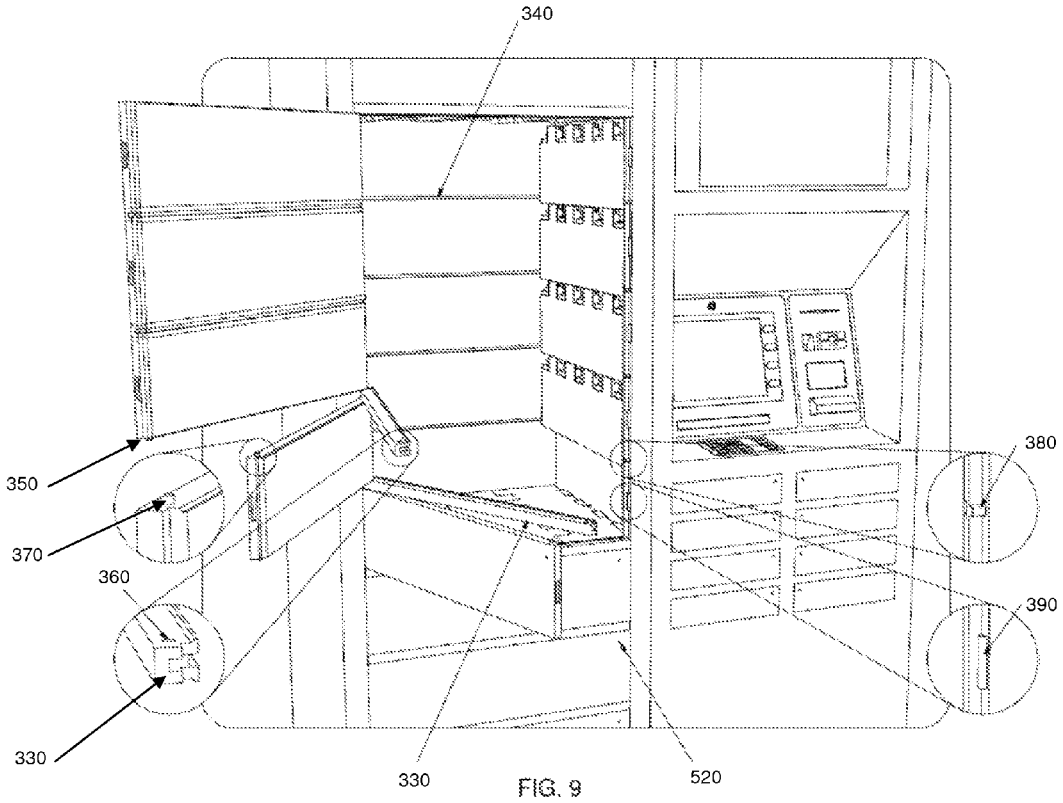
FIG. 9 is a front view of the automated article delivery and collecting machine illustrating the door mechanism in detail.

In certain embodiments, a joined door configuration may be achieved by the following mechanism illustrated within FIG. 9. Each door may have two joining pins, one at the top side (370) and the other at the bottom side (350) of the door. The joining pins (350) and (370) may attach the two doors together. For example, the bottom joining pin (350) of the higher positioned door will be activated and engage the joining hole (360) of the lower positioned guide rail (330) and at the same time the upper joining pin (370) of the lower positioned door will be activated and engage the joining hole (360) of higher positioned (same) guide rail (350). In certain embodiments, the joining pins (350 and 370) may be activated by an electric actuator embedded in each door and controlled by the storage unit processor board. Each door may include an electric lock which is controlled by the storage unit processor board. In certain embodiments, an LED light (520) is incorporated onto the front of each door. In certain embodiments, the LED light (520) may be designed to flash when the door is opened and unlocked to acknowledge the user or operator and the available/selected compartment to deposit or retrieve the articles.

B-2) Guide Rails:

With continued reference to FIG. 9, there are two guide rails (330 and 340) for each shelf within the storage unit (300). One guide rail is a fixed guide rail (330) at the back side of the storage unit (300). The other guide rail is a movable guide rail at the front side of the storage unit (300). The guide rails (330 and 340) have three main functionalities. First, they provide a guiding path (grooves) to accommodate the shelves guide pins (620) during the movement of the shelves to keep them in the right position. Second, the guide rails (330 and 340) provide support to the shelves and hold their weight in addition to the load of the articles placed on the shelves when the shelves are not in the folded position. Third, the front guide rail (330) seals the gap between the doors (310) to provide additional physical security.

In certain embodiments, the front guide rail (330) may from one end connect with a hinge to the side of the storage unit (300) and from the opposite end seat on a rest (380) on the other side of the storage unit (300). The rest (380) may precisely secure the guide rail (330) at the correct position and also provide strength to hold the guide rail (330) in place.

In further embodiments, the door may from one end connect with a hinge to the side of the storage unit (300) and from the opposite end seat on a rest (390) on the other side of the storage unit (300). The rest (390) may precisely secure the door at the correct position and also provide strength to hold the door in place.

In certain embodiments, the guide rails (330 and 340) are always attached to the storage unit (300) when the corresponding shelf is flat and not in the folded position. The shelf (600) may be maintained in the flat position by the activated guide pins (620) engaging the guide rail (330) on the front side of the storage unit (300) and by guide pins (620) engaging the guide rail (340) on the back side of the storage unit (300). In certain embodiments, the guide pins (620) will be not be released unless the corresponding shelf (600) is to be removed. This function may be controlled by the storage unit (300) process board.

Figure 7:
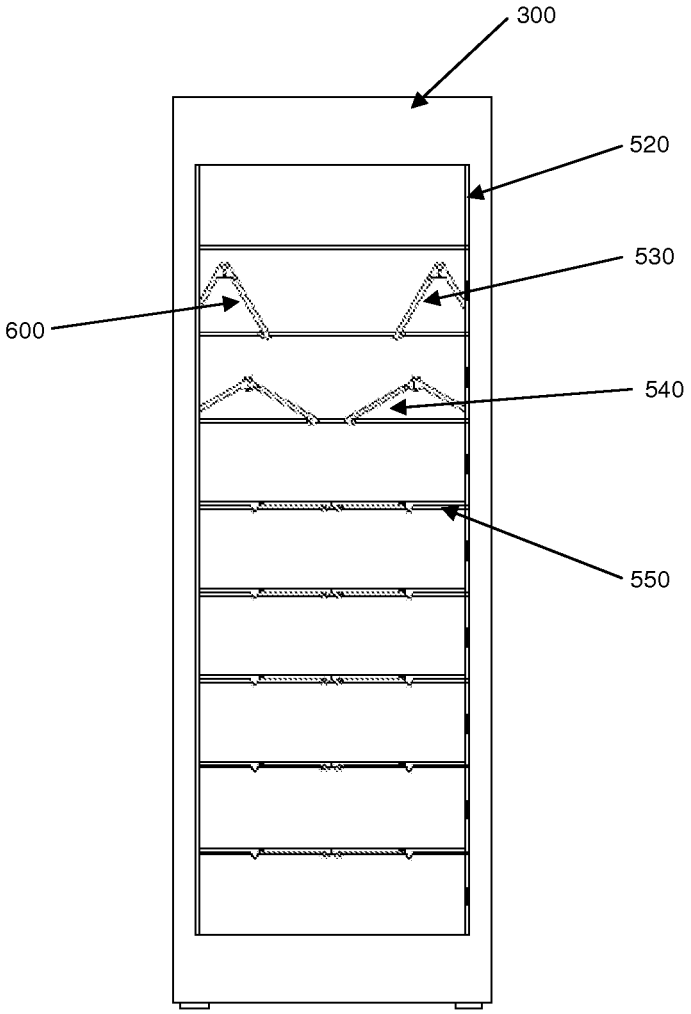
FIG. 7 is a front view of the storage compartments and shelves of the automated article delivery and collecting machine in different retracting stages in accordance to FIG. 6.
Figure 8:
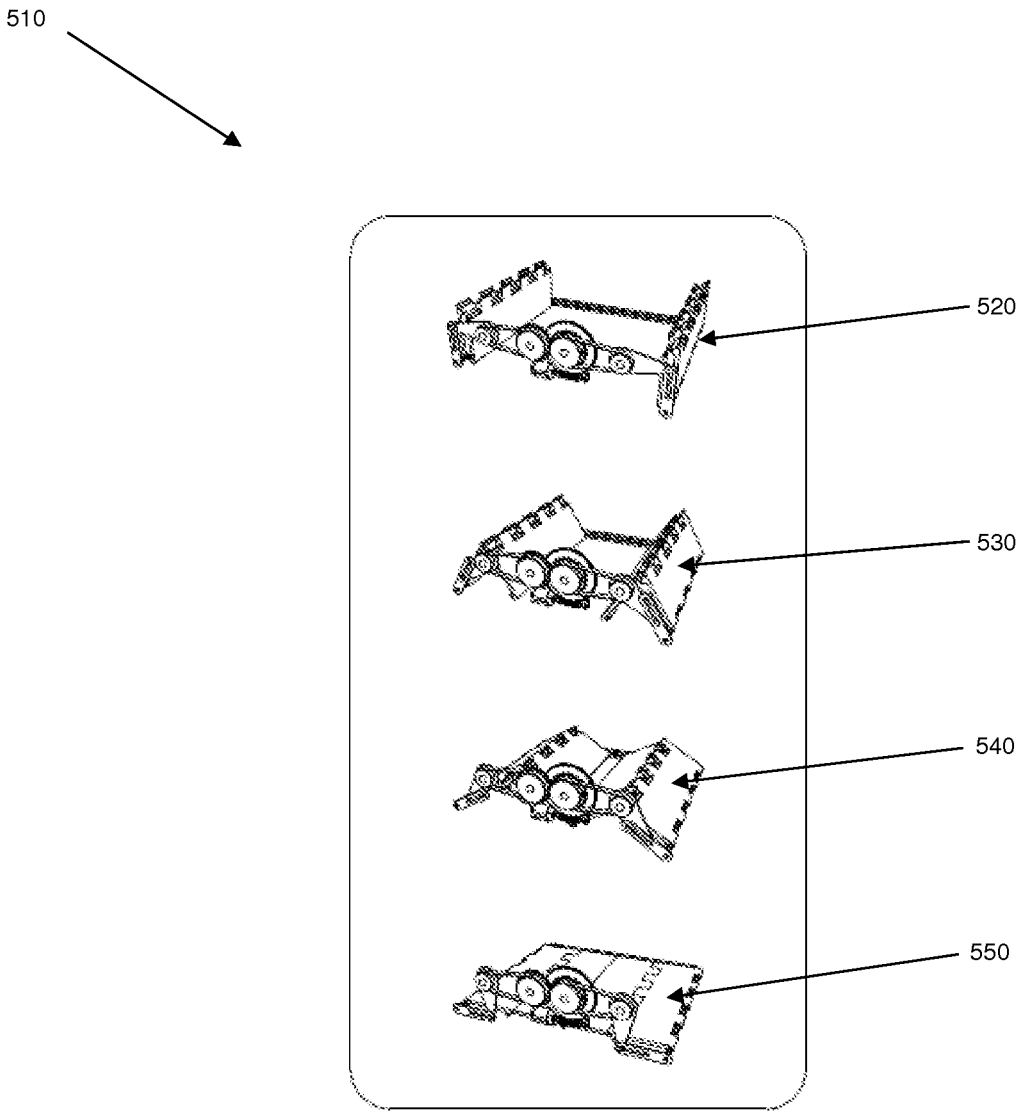
FIG. 8 is a perspective view of the shelf mechanism of the automated article delivery and collecting machine in different retracting stages.
Figure 10:
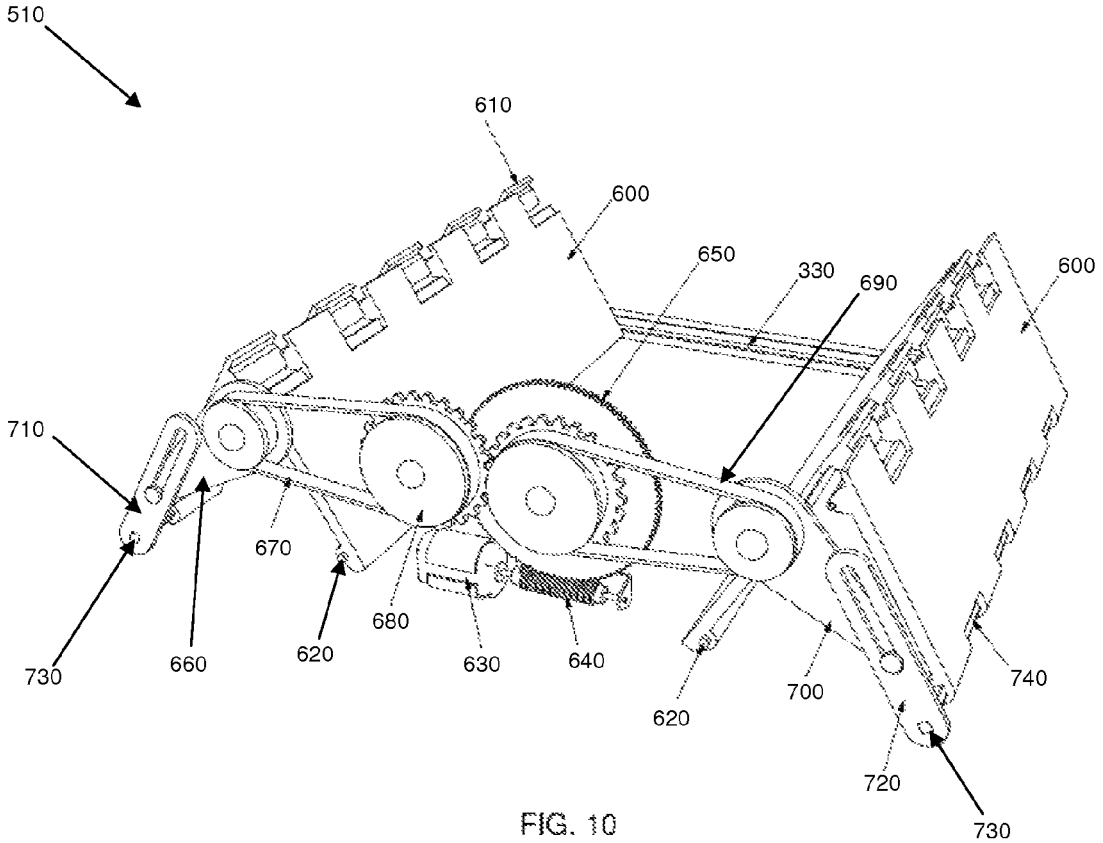
FIG. 10 is a perspective view of the shelf mechanism of the automated article delivery and collecting machine.

B-3) Retractable Shelf Mechanism:

An exemplary shelf and shelf mechanism (510) is illustrated within FIGS. 7, 8 and 10. In certain embodiments, each shelf is made from two foldable parts, and each foldable part is made of two sub-shelf members (600) joined together from the middle by multiple lap joints (610). To fold the shelves and remove them, the foldable parts may fold from the middle and turn 90 degrees to be re-positioned and hidden at the side of the storage unit (300). The lap joints (610) are designed to obtain maximum strength when the shelf is in the flat position and to prevent the surface of the foldable parts from bending more than 90 degrees.

Each foldable part has two guide pins (620), one at the front side of the foldable part and the other one at the back side of the foldable part. The guide pins (620) will move inside the guide rail (330) to hold the foldable parts in the correct position during the retracting process and provide more strength to the shelves to hold a load when the shelves are in the flat position.

In certain embodiments, a bidirectional electric motor (630) provides the force necessary to move or to retract the shelves to a folded position and to extend the shelves to a flat position. In certain embodiments, the electric motor (630) may turn and transfer force to a shaft, which in turn transfers force to a gear (640), which in turn transfers force to a main movement gear (650). In certain embodiments, the main movement gear (650) transfers force to a moving arm (660) by a belt (670) from one side via a coupling gear (680) and another moving belt (690) to another moving arm (700). The moving arms (660 and 700) are connected to the foldable parts (600) by connecting arms (710 and 720 respectively)

and the connecting arms (710 and 720) are attached to the foldable part (600) via a square shaft (740) positioned within a square shaft insert (730). By operating the electric motor (630) in one direction, both foldable parts will move to the sides of the storage unit (300) causing the foldable parts to be positioned in an upright or vertical position. This process removes the shelf from the storage compartment causing two storage compartments to merge together. Operating the electric motor (630) in the opposite direction will return the foldable parts to the flat position to form the shelf within the storage compartment.

As illustrated within FIGS. 5, 6, 7 and 8, the disclosed shelves and shelf mechanism (510) may retract or extend in a variety of different positions. FIG. 8 illustrates four different positions of the shelf mechanism (510) as it moves from a fully retracted state to a fully extended state. From top to bottom those positions within FIG. 8 are referred to as a first position (520) (a fully retracted position), a second position (530) (a partially retracted or extended position), a third position (540) (a partially retracted or extended position), and a fourth position (550) (a fully extended position). The positions of the sub-shelf members (600) achieved by the shelf mechanism (510) within FIG. 8 are further illustrated within FIG. 6 which illustrates the various positions (520, 530, 540 and 550) of the corresponding shelf mechanisms (510) which cause the sub-shelf members (600) to vary between fully retracted, partially retracted or partially extended and fully extended positions. The positions of the sub-shelf members (600) achieved by the shelf mechanism (510) within FIG. 8 are further illustrated within FIG. 7 which illustrates the various positions (520, 530, 540 and 550) of the corresponding sub-shelf members (600) between fully retracted, partially retracted or partially extended and fully extended positions. Access to the shelf mechanisms (510) may be obtained by removing a back cover (800) on the back wall of the storage unit (300).

B-4) Processor Board

Each storage unit may include a processer board (not shown here). In certain embodiments, the processor board may include a processor, memory, software, and analog to digital convertor (ADC), a power supply, and a universal serial port (USB Port) to communicate with the control unit.

In the event that an item to be stored is greater than the size of a single storage compartment, for example, requiring twice the size of the default storage compartments, the control unit instructs the storage unit processor board to retract one shelf and join the upper and lower doors corresponding to the default storage compartments together to create a larger storage space, which is twice the size of a default storage compartment. This may be accomplished by retracting one shelf member. In such a case, the shelf member micro-switch will be activated (not shown here) to send the corresponding information to the control unit and update the storage compartment configuration based on the new arrangement. Subsequent steps are similar to what has been explained earlier.

In certain embodiments, the processor board controls, monitors and diagnoses the functionality of the storage unit and continuously provides the storage unit status and configuration to the control unit. The process board may also receive and execute instructions from the control unit in certain embodiments.

In certain embodiments, the control unit includes a computer and software which allows users and operators access to the graphical user interface and input details. For example, the user may be a postman and need to use the user interface to input the size of the article to be deposited in the apparatus. In such a case, the dimensions or size needed for the storage compartment is stored in the memory of the control unit based on the size entered by the user. The apparatus can allocate and select available storage compartments for the article to be deposited within the apparatus.

In certain embodiments, the user interface may be mounted towards the top portion of the control unit and the user interface may include touch screen functions (or keypads) for a user to input details. For example, the user may be a mailman or postman who uses the user interface to input the size of the mail or item to be deposited in the storage unit of the apparatus. Dimensions (e.g., height, depth and width, or weight which the storage compartment can support) of each of the storage compartments may be stored in the memory of the control system. Based on the size requested, the apparatus (i.e., the processor) allocates a storage section for the item which is selected from at least one of the storage compartments.

In an alternative embodiment, the user interface may include a barcode scanner. The barcode scanner may be capable of scanning articles which include a barcode. The barcode on such articles may contain information pertaining to the item to be deposited within the storage unit. In such case, the user merely scans the barcode to transfer the information to the control unit. Assuming that available storage compartments may accommodate the size of the item, the control unit can allocate the first storage compartment and instruct the storage unit processor board to activate the storage compartment door lock to unlock it and turn the door LED light in flashing mode to alert the user or operator. The user next places the item into the first storage compartment and closes the door. The processor board can receive the information from a micro switch installed on the door (not shown here) and activates the lock and secure the door and turn off the LED indicator. The processor board then transmits a corresponding message to the control unit. The control unit then updates the main server which controls a number of such apparatuses. The main server next generates a unique code or identifier which will be sorted in its memory and it is in association with the location of the items.

In further embodiments, the main server may generate security information including the code and the physical location of the apparatus and send a notification including the security information to the recipient of the item so that item may be retrieved by the recipient. The notification may be sent by way of Short Message Service (SMS) to a mobile phone of the recipient, electronic mail or by any other suitable means known to those of suitable skill in the art. In certain embodiments, a central registry generates security information including the unique code and sends a notification which includes the security information to the recipient of the item so that the item may be retrieved by the recipient. The notification may be sent from the central registry by way of SMS to a mobile phone of the recipient, electronic mail or other suitable means.

As it can be appreciated, the recipient may pick up items at his/her convenience and not be restricted to the opening or closing time of traditional mail centers, such as post offices. When the recipient arrives at the apparatus, the recipient uses the touch screen and graphical user interface (or keypads) to input the unique code. Upon receipt of the unique code from the user interface, the control unit passes it on to the main server to validate it and after receiving confirmation from the main server, it then instructs the processor board of the related storage unit to activate and unlock the storage compartment and flash the LED light to inform the user about the exact location of the storage compartment. The recipient can then retrieve the article and close the door.

Further, the recipient of the item deposited in the apparatus may be given a specific time frame to collect the item, perhaps at no charge, and a further time limit perhaps at a charge. For example, the recipient may be informed that the item should be retrieved within 48 hours, and that beyond this time frame, a charge of $5 per day would be imposed to encourage collection of the deposited item. Also, the recipient might be warned that if the item is not collected before the set time limit, the item might be returned to the sender. In such a case, the control unit may trigger the main server that the item has not been collected and a central office would then inform the sender accordingly. The central office may also retrieve the item for delivering back to sender in some cases.

As it can be appreciated, the apparatus provides great flexibility and convenience to delivery companies and merchants as well as to recipients.

As it can further be appreciated, the access opening is variable to accommodate different sizes of articles with re-configured and appropriately sized storage compartments. This provides greater flexibility and convenience to users and operators.

Such an apparatus has many applications and uses, not just as a mail box. For example the apparatus may be used for any one of the following non-limiting applications:

1) sending and receiving courier, express and postal shipments;
2) depositing or storing goods for a period of time;
3) secured handover of items for private or business purposes;
4) document exchange;
5) 24/7 shopping counter for certain stores (e.g., Laundromats);
6) handling shipment from ecommerce platforms like Amazon™ and EBay™ and depositing the items in the apparatus for self-collection by the recipient/purchaser;
7) library uses (for return of the books), DVD rental terminals, etc.

Another advantage is that the apparatus may be placed in any one of the following non-limiting places:

1) public areas;
2) petrol/gas stations;
3) supermarkets;
4) malls;
5) train, bus, metro, airports or any transport station;
6) compounds or residential or commercial offices;
7) health clubs; and,
8) hotels, etc.

Furthermore, any number of the above-described apparatuses may be arranged in a line or a row to increase the capacity of storing articles. In this manner, the control unit may be located in a more central location or manner.

It should be appreciated that the control unit may be expanded to include other ancillary functions such as a self-service kiosk, for postal services such as for the sale of stamps, for point of sale for credit card facilities, cash/money dispensing, and cash/money depositing/collection such as ATM machines.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A storage unit for depositing articles for subsequent retrieval, the storage unit comprising:

a plurality of storage compartments;

at least one retractable and foldable shelf member within each storage compartment, each retractable and foldable shelf member having a front side and a back side;

a set of doors configured to cooperate with each other and movable between a closed configuration which disallows access to the plurality of storage compartments and an opened configuration which allows access to the plurality of storage compartments; and a control system comprising a computer, a processor board and software for receiving and processing an input and for moving the set of doors to the open configuration based on the input and to selectively define an access opening between the set of doors for accessing a storage section, the storage section being selected from at least one of the storage compartments wherein the at least one retractable and foldable shelf member within each storage compartment defines the size of the storage compartment, the retractable and foldable shelf member being movable between an in-use position in which the shelf members are arranged for supporting the articles to be deposited and a stored position which merges at least two of the storage compartments to create a larger storage compartment and wherein each shelf member includes two foldable parts which are foldable along at least one lap joint.

2. The storage unit according to claim 1, wherein the input includes a dimension of the article to be deposited, wherein the control system is configured to assign at least one of the storage compartments as the storage section based on the dimension and wherein the input includes a unique code which is associated with the storage section.

3. The storage unit according to claim 2, wherein two or more storage compartments are assigned as the storage section and wherein the access opening is arranged to match openings of the two or more storage compartments.

4. The storage unit according to claim 3, wherein the control system calculates freight charge and wherein payment may be accepted by debit/credit card through a smart card reader and writer, Near Field Communication (NFC) through a NFC/RFID card reader or cash through a cash recycle unit to dispense and deposit bank notes.

5. The storage unit according to claim 4, wherein the control system includes a touch screen display for entering an input, a graphical user interface which allows users to enter details of a sender and a receiver of an article, a printer to print shipment documents and payment receipts, a finger print scanner to identify operators, a barcode scanner to enter shipping and receiving information from article barcodes, a security camera to record activities during operation, a secure Personal Identification Number (PIN) pad, and a display screen for advertisements.

6. The storage unit according to claim 1, wherein each shelf member is foldable at the middle of the shelf along the at least one lap joint, wherein the foldable parts fold from the middle and turn approximately 90 degrees to position the two foldable parts along the interior wall of the storage unit.

7. The storage unit according to claim 1, wherein the two foldable parts of each shelf member are horizontally positioned and fold from the middle and turn approximately 90 degrees to position the two foldable parts at a first side wall, a second side wall, a back wall or a front wall along the interior wall of the storage unit.

8. The storage unit according to claim 7, wherein each storage compartment includes at least two retractable and foldable shelf members.

9. The storage unit according to claim 8, wherein a first retractable and foldable shelf member folds from the middle and turns approximately 90 degrees to position the two foldable parts at a back wall along the interior wall of the storage unit and a second retractable and foldable shelf member folds from the middle and turns approximately 90 degrees to position the two foldable parts at a front wall along the interior wall of the storage unit, further wherein access to the storage compartment is provided by one of the first or second side wall on the storage unit.

10. The storage unit according to claim 8, wherein a first retractable and foldable shelf member folds from the middle and turns approximately 90 degrees to position the two foldable parts at a first side wall along the interior wall of the storage unit and a second retractable and foldable shelf member folds from the middle and turns approximately 90 degrees to position the two foldable parts at a second side wall along the interior wall of the storage unit.

11. The storage unit according to claim 10, wherein the retractable and foldable shelf members include a guide pin on the front side and a guide pin on the back side of the shelf member, each guide pin being capable of moving inside a corresponding front side and back side guide rail to hold the foldable parts in the correct position during the retracting process, to provide more strength to the shelves to hold a load at the flat position, and to provide a seal between the doors of the storage unit.

12. The storage unit according to claim 11, wherein a bidirectional electric motor provides movement to retract the foldable shelf members, further wherein the bidirectional electric motor turns a shaft transferring movement to a first gear, wherein movement of the first gear transfers movement to a main movement gear, wherein movement of the main movement gear transfers movement to a first moving arm by a first belt and a second movement arm by a coupling gear and a second belt, wherein the moving arms are connected to the foldable parts by connecting arms and the connecting arms are attached to the foldable parts by a square shaft.

13. The storage unit according to claim 12, further comprising a lock mechanism arranged to lock the set of doors in the closed configuration and unlock the set of doors in the open configuration, wherein the lock mechanism comprises an electric lock which is controlled by the storage unit processor board.

14. The storage unit according to claim 13, wherein the set of doors includes a door having a top side and a bottom side corresponding to each storage compartment and a guide rail having a top side and a bottom side between each door, wherein the top side of each door includes a joining pin which can engage a hole in the bottom side of the guide rail and the bottom side of each door includes a joining pin which can engage a hole in the top side of the guide rail, wherein the joining pins are activated by an electric actuator embedded in each door and controlled by the storage unit processor board.

15. The storage unit according to claim 14, wherein the back side guide rail is in a fixed position and the front side guide rail is movable, further wherein the set of doors and the front side guide rail have one of a right hand swing, a left hand swing, a top swing and a bottom swing.

16. A method of operating the storage unit of claim 1 for depositing the articles for subsequent retrieval, the method comprising:

entering an input into the control system which includes the article's dimensions;

allowing the control system to retract or extend the foldable shelf member from at least one of the storage compartments based on the dimension of the article entered with the input;

allowing the control system to selectively define the access opening by determining a number of the doors to be mechanically connected and opened together;

allowing the control system to send an instruction to mechanically connect the appropriate number of the doors based on the determined size of the storage compartment;

moving the set of doors to the open configuration based on the entered input to create the access opening to the storage section;

placing the article within the storage compartment; and closing the set of doors.

17. A storage unit for depositing articles for subsequent retrieval, the storage unit comprising:

a plurality of storage compartments;

two retractable and foldable shelf members within each storage compartment, each retractable and foldable shelf member having a front side and a back side, wherein the retractable and foldable shelf members within each storage compartment define the size of the storage compartment, the retractable and foldable shelf members being movable between an in-use position in which the shelf members are arranged for supporting articles to be deposited and a stored position which merges at least two of the storage compartments to create a larger storage compartment, wherein each shelf member includes two foldable parts which are foldable along multiple lap joints, wherein each shelf member is foldable at the middle of the shelf along the multiple lap joints, wherein a first retractable and foldable shelf member folds from the middle and turns approximately 90 degrees to position the two foldable parts at a first side wall along the interior wall of the storage unit and a second retractable and foldable shelf member folds from the middle and turns approximately 90 degrees to position the two foldable parts at a second side wall along the interior wall of the storage unit;

a set of doors configured to cooperate with each other and movable between a closed configuration which disallows access to the plurality of storage compartments and an opened configuration which allows access to the plurality of storage compartments;

a lock mechanism arranged to lock the set of doors in the closed configuration and unlock the set of doors in the open configuration, wherein the lock mechanism comprises an electric lock which is controlled by a storage unit processor board, wherein the set of doors includes a door having a top side and a bottom side corresponding to each storage compartment and a guide rail having a top side and a bottom side between each door, wherein the top side of each door includes a joining pin which can engage a hole in the bottom side of the guide rail and the bottom side of each door includes a joining pin which can engage a hole in the top side of the guide rail, wherein the joining pins are activated by an electric actuator embedded in each door and controlled by the storage unit processor board, wherein the back side guide rail is in a fixed position and the front side guide rail is movable, wherein the set of doors and the front side guide rail have one of a right hand swing and a left hand swing;

a bidirectional electric motor which provides movement to retract the foldable shelf members, wherein the bidirectional electric motor turns a shaft transferring movement to a first gear, wherein movement of the first gear transfers movement to a main movement gear, wherein movement of the main movement gear transfers movement to a first moving arm by a first belt and a second movement arm by a coupling gear and a second belt, wherein the moving arms are connected to the foldable parts by connecting arms and the connecting arms are attached to the foldable parts by a square shaft; and a control system comprising a computer, the processor board and software for receiving and processing an input and for moving the set of doors to the open configuration based on the input and to selectively define an access opening between the set of doors for accessing a storage section, the storage section being selected from at least one of the storage compartments, wherein the input includes a dimension of an article to be deposited, and the control system is configured to assign at least one of the storage compartments as the storage section based on the dimension and wherein the input includes a unique code which is associated with the storage section, wherein two or more storage compartments are capable of being assigned as the storage section, wherein the access opening is capable of being arranged to match openings of the two or more storage compartments, wherein the control system calculates freight charge, wherein payment may be accepted by debit/credit card through a smart card reader and writer, Near Field Communication (NFC) through a NFC/RFID card reader or cash through a cash recycle unit to dispense and deposit bank notes, wherein the control system includes a touch screen display for entering an input, a graphical user interface which allows users to enter details of a sender and a receiver of an article, a printer to print shipment documents and payment receipts, a finger print scanner to identify operators, a barcode scanner to enter shipping and receiving information from article barcodes, a security camera to record activities during operation, a secure Personal Identification Number (PIN) pad, and a display screen for advertisements.

* * * * *